US007284718B2

(12) United States Patent
Christenson

(10) Patent No.: US 7,284,718 B2
(45) Date of Patent: Oct. 23, 2007

(54) EXCAVATOR DEMOLITION ATTACHMENT WITH INTERCHANGEABLE JAW ASSEMBLIES

(75) Inventor: Ross D. Christenson, Esko, MN (US)

(73) Assignee: Genesis Attachments, LLC, Cedar Rapids, IA (US)

( * ) Notice: Subject to any disclaimer, the term of this patent is extended or adjusted under 35 U.S.C. 154(b) by 210 days.

(21) Appl. No.: 11/169,562

(22) Filed: Jun. 29, 2005

(65) Prior Publication Data

US 2007/0001041 A1 Jan. 4, 2007

(51) Int. Cl.
*B02C 1/02* (2006.01)

(52) U.S. Cl. ..... 241/101.73; 241/266

(58) Field of Classification Search ..... 241/101.72, 241/101.73, 266; 30/134; 83/609
See application file for complete search history.

(56) References Cited

U.S. PATENT DOCUMENTS

| | | | |
|---|---|---|---|
| 4,198,747 | A | 4/1980 | LaBounty |
| 4,382,625 | A | 5/1983 | LaBounty |
| 4,403,431 | A | 9/1983 | Ramun et al. |
| 4,450,625 | A | 5/1984 | Ramun et al. |
| 4,512,524 | A | 4/1985 | Shigemizu |
| 4,519,135 | A | 5/1985 | LaBounty |
| 4,543,719 | A | 10/1985 | Pardoe |
| 4,558,515 | A | 12/1985 | LaBounty |
| 4,669,187 | A | 6/1987 | Pardoe |
| 4,670,983 | A | 6/1987 | Ramun et al. |
| 4,686,767 | A | 8/1987 | Ramun et al. |
| 4,697,509 | A | 10/1987 | LaBounty |
| 4,771,540 | A | 9/1988 | LaBounty |
| 4,776,093 | A | 10/1988 | Gross |
| 4,838,493 | A | 6/1989 | LaBounty |
| 4,881,459 | A | 11/1989 | Ramun |
| 4,897,921 | A | 2/1990 | Ramun |

(Continued)

FOREIGN PATENT DOCUMENTS

DE 4205781 2/1993

(Continued)

OTHER PUBLICATIONS

Brochure, LaBounty Universal Processor Shear Jaws Attachment.

(Continued)

*Primary Examiner*—Mark Rosenbaum
(74) *Attorney, Agent, or Firm*—Gerald E. Helget; Briggs and Morgan, P.A.

(57) ABSTRACT

A heavy-duty demolition apparatus for attachment to the boom structure of an excavator, the apparatus having interchangeable jaw sets. The apparatus includes a unitary jaw assembly, having a pair of pivoting jaws connected by a main pivot pin; a first adaptor on the boom structure; a second adaptor on the jaw assembly, the second adaptor engaging the first adaptor, so that the jaw assembly can be easily removed as a unit from the boom structure and another jaw assembly installed on the boom structure; and a lock pin fixed to the first adapter and engaging the second adapter to maintain the jaw assembly in locked relationship to the boom structure. Because of the structure of the apparatus, the distance between the attachment point of the hydraulic ram on the boom structure and the main pivot point of the jaw assembly can be varied between interchangeable jaw assemblies.

25 Claims, 8 Drawing Sheets

U.S. PATENT DOCUMENTS

| | | | | |
|---|---|---|---|---|
| 4,951,886 | A | 8/1990 | Berto | |
| 5,044,569 | A | 9/1991 | LaBounty et al. | |
| 5,060,378 | A | 10/1991 | LaBounty et al. | |
| 5,062,227 | A | 11/1991 | De Gier et al. | |
| 5,146,683 | A | 9/1992 | Morikawa et al. | |
| 5,183,216 | A | 2/1993 | Wack | |
| 5,187,868 | A | 2/1993 | Hall | |
| 5,230,151 | A | 7/1993 | Kunzman et al. | |
| 5,339,525 | A | 8/1994 | Morikawa | |
| 5,384,962 | A | 1/1995 | Pemberton | |
| 5,385,311 | A | 1/1995 | Morikawa et al. | |
| 5,474,242 | A | 12/1995 | Rafn | |
| 5,478,019 | A | 12/1995 | Morikawa et al. | |
| 5,533,682 | A | 7/1996 | de Gier et al. | |
| RE35,432 | E | 1/1997 | LaBounty | |
| 5,619,881 | A | 4/1997 | Morikawa et al. | |
| 5,669,141 | A | 9/1997 | Morikawa et al. | |
| 5,671,892 | A | 9/1997 | Morikawa et al. | |
| 5,715,603 | A | 2/1998 | Dorguin | |
| 5,738,289 | A * | 4/1998 | Tagawa | 241/266 |
| 5,860,214 | A | 1/1999 | Morikawa et al. | |
| 5,873,168 | A | 2/1999 | Johnson et al. | |
| 5,894,666 | A | 4/1999 | Hrusch | |
| 5,926,958 | A | 7/1999 | Ramun | |
| 5,992,023 | A | 11/1999 | Sederberg et al. | |
| 6,061,911 | A | 5/2000 | LaBounty et al. | |
| 6,119,970 | A | 9/2000 | LaBounty et al. | |
| 6,202,308 | B1 | 3/2001 | Ramun | |
| 6,298,560 | B1 | 10/2001 | Lee | |
| 6,438,874 | B1 | 8/2002 | LaBounty et al. | |
| 6,655,054 | B1 | 12/2003 | Ward | |
| 6,839,969 | B2 | 1/2005 | Jacobson et al. | |
| 6,926,217 | B1 | 8/2005 | LaBounty | |
| 6,994,284 | B1 * | 2/2006 | Ramun | 241/266 |
| 2002/0011535 | A1 | 1/2002 | Cook | |

FOREIGN PATENT DOCUMENTS

| | | | |
|---|---|---|---|
| DE | 29708705 | U1 | 7/1997 |
| DE | 29715490 | U1 | 12/1997 |
| EP | 0353363 | A | 2/1990 |
| EP | 0751260 | A | 1/1997 |
| FR | 2822482 | A1 | 9/2002 |
| GB | 2126938 | A | 4/1984 |
| GB | 2236965 | A | 4/1991 |
| JP | 01010827 | A | 1/1989 |
| JP | 9195528 | | 7/1997 |
| SU | 1021442 | A | 6/1983 |
| WO | WO-2004/013417 | A1 | 2/2004 |

OTHER PUBLICATIONS

Photographs and literautre—Teledyne Shear.
Literature Veratech Shear Attachments.
Literature, Iron Ax Shears.
Photographs, Komatsu (Oyodo) Shear.
Product Drawing ORT Oberlander Shear.

* cited by examiner

EXCAVATOR DEMOLITION ATTACHMENT WITH INTERCHANGEABLE JAW ASSEMBLIES

BACKGROUND OF THE INVENTION

A fuller understanding of the operation of the demolition apparatus of the present invention may be achieved by studying U.S. Pat. No. 4,519,135, hereby incorporated by reference. This invention relates to a heavy duty demolition apparatus, especially adapted to be mounted on a rigid boom of a mobile vehicle and particularly adapted to be mounted on the dipper stick of an excavator, and particularly to such an apparatus with interchangeable jaws.

Heavy duty shears of the type that are powered by hydraulic cylinders are proving more and more useful in handling scrap and especially metal scrap of all sorts. Such scrap comes in many different forms, and may be in the form of pipes made of steel or soft iron or cast iron, ranging in sizes from 2 inches or smaller, and up to 8 or 10 inches in diameter or larger; structural beams such as I-beams, channels, angle beams in a large range of sizes, up to 8 or 10 inches across and larger; rods and heavy cables having diameters of 2 to 3 inches and larger, metal sheets and plates and formed metal of all sorts including wheels and automobile and truck frames, and a myriad of long and short pieces of stock and metal pieces that are cast, rolled, stamped or otherwise formed, both singly and in various types of assembly.

The prior art has included numerous shears such as that illustrated in U.S. Pat. Nos. 4,198,747; 4,188,721; 4,897,921; 4,543,719; 4,558,515 and 4,104,792. Typically, these heavy duty shears mount on the dipper stick of an excavator so that the shears may be controlled fairly well in handling various types of scrap and cutting the scrap into smaller twisted and contorted pieces and lengths as the scrap is drawn into the throat of the shear.

Typically, these shears have a fixed lower jaw and a movable upper jaw that pivots on the lower jaw, with shear blades of hardened steel on both the upper jaw and the lower jaw. The workpiece is sheared by closing the upper jaw against the lower jaw under hydraulic pressure, with the shear blades cutting the workpiece.

Shears such as these have various types of jaw attachments that may be used, for example, for cutting steel or other structural material, including concrete, or for crushing concrete, rock, or coral. Thus, it is desirable to be able to remove the jaws from the shear and replace them with jaws of another type. In the past, this has been done by detaching the jaws at the main pivot point. The main pivot pin of the jaws was slid out of the jaws and the adjacent frame plates. It was also necessary to disconnect pivot pins that attached the jaws to their hydraulic cylinders.

One problem with shears such as this is that the main pivot pin cannot be made very heavy and durable, as it must be slid out from the jaws. Also, the main pivot pin was subject to contamination when changing jaws. Furthermore, removing the main pivot pin exposed operating personnel to injury, as either the pin itself or the jaws might cause injury as the pin was removed.

There is a need for a heavy duty demolition shear with interchangeable jaw assemblies that can be easily mounted and demounted to the apparatus.

SUMMARY OF THE INVENTION

A heavy-duty demolition apparatus for attachment to the boom structure of an excavator, the apparatus having interchangeable jaw assemblies. The apparatus includes a unitary jaw assembly, having a pair of pivoting jaws connected by a main pivot pin; a first adaptor on the boom structure; a second adaptor on the jaw assembly, the second adaptor engaging the first adaptor, so that the jaw assembly can be easily removed as a unit from the boom structure and another jaw assembly installed on the boom structure; and a lock pin fixed to the first adapter and engaging the second adapter to maintain the jaw assembly in locked relationship to the boom structure.

A principal object and advantage of the present invention is that a jaw assembly can be removed as a unit without removing the main pivot pin from the jaw assembly.

Another principal object and advantage of the present invention is that the main pivot pin can be made stronger than in shears where the main pivot pin must be removed to detach the jaws from the boom structure.

Another principal object and advantage of the present invention is that the main pivot pin is not subject to contamination because it is never removed from the jaws.

Another principal object and advantage of the present invention is that the jaws have hooks which mate with slots on the boom structure, so that the jaws may simply be placed on the ground and the boom structure manipulated to hook onto the jaws.

Another principal object and advantage of the present invention is that the jaw assembly is attached to the boom structure by a hydraulically activated lock pin which is a part of the boom structure and thus easily used to secure the jaw assembly to the boom structure.

Another principal object and advantage of the present invention is that the jaw assembly may rest on the ground and be easily mounted to the boom structure by hooking the jaw assembly to the boom structure then lifting the jaw assembly to make contact with a stop on the boom structure.

Another principal object and advantage of the present invention is that the distance between the attachment point of the hydraulic cylinders on the excavator boom structure and the main pivot pin can be varied between different interchangeable jaw assemblies to produce different shearing actions.

Another principal object and advantage of the present invention is that the distance between the lock pin and the main pivot pin can be varied between different interchangeable jaw assemblies to produce different shearing actions.

Another principal object and advantage of the present invention is that the distance between the attachment point of the hydraulic ram on the jaw assembly and the main pivot pin can be varied between different interchangeable jaw assemblies to produce different shearing actions.

Other advantages will be understood from reading the Detailed Description of Preferred Embodiments.

DETAILED DESCRIPTION OF THE PREFERRED EMBODIMENTS

Figure 1:
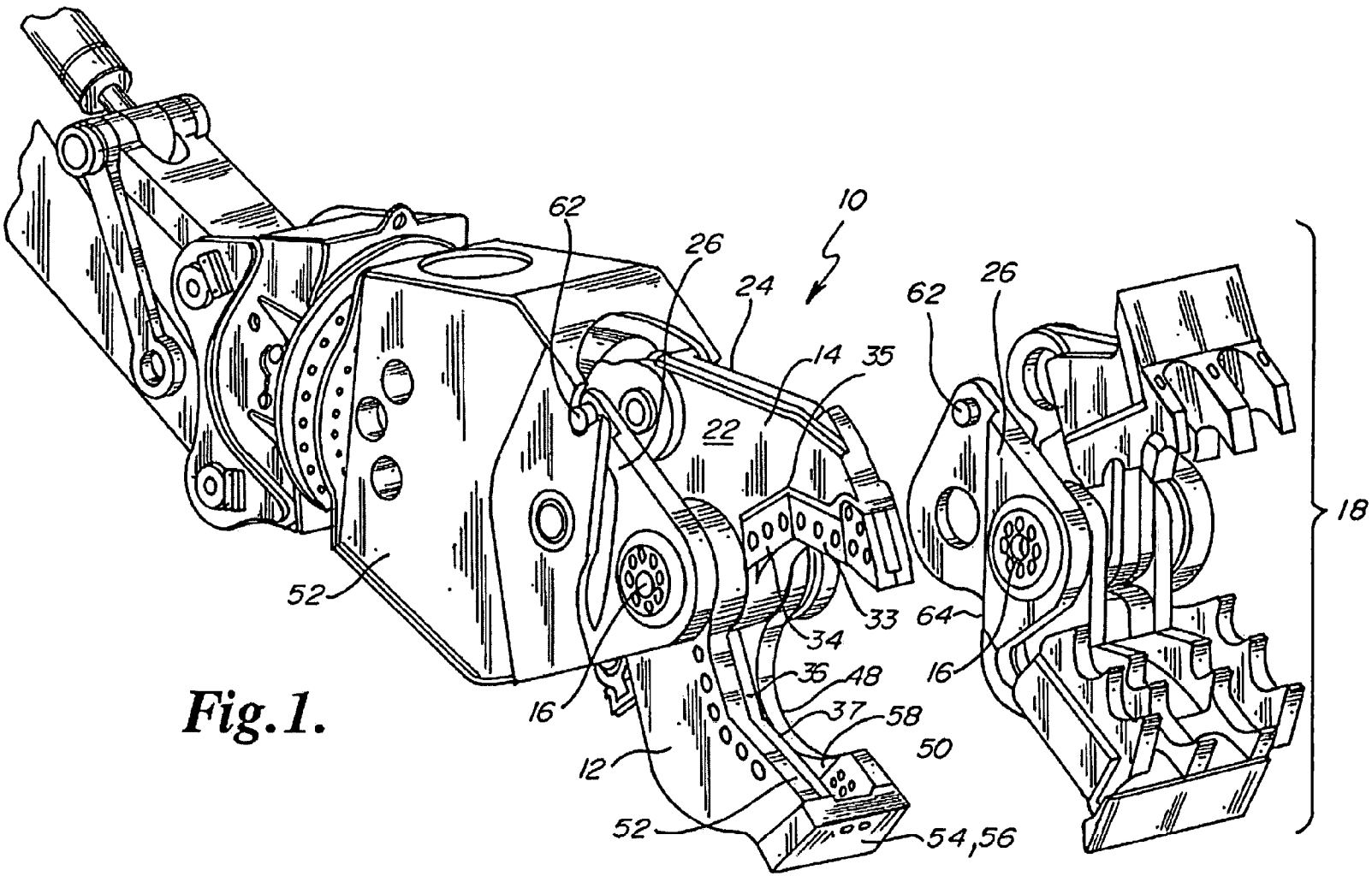
FIG. 1 is a perspective view of the present invention attached to the boom structure of an excavator, showing the interchangeable jaw assembly separate from and attached to the apparatus. One jaw assembly (attached to the boom structure) is used for shearing, while the other jaw assembly is used for crushing.

The heavy-duty demolition apparatus of the present invention is generally referred to in the Figures as reference numeral 10.

Referring to FIG. 1, the heavy-duty demolition apparatus 10 has a lower jaw 12, an upper jaw 14, and pivot pin 16 interconnecting the lower jaw 12 and upper jaw 14. The lower jaw 12, upper jaw 14, and pivot pin 16 comprise a unitary jaw assembly 18.

The upper jaw 14 has a first side 22, and a second side 24. The lower jaw 12 has a first mounting plate 26 adjacent the first side 22, and a second mounting plate 28 (FIG. 3) adjacent the second side 24. The first mounting plate 26 and second mounting plate 28 receive the pivot pin 16 between them.

The upper jaw 14 typically has upper shear blades 33 and 34 meeting at apex 35 and the lower jaw 12 typically has lower shear blades 36 and 37 extending along each other for shearing a work-piece when the upper shear blades 33 and 34 are closed upon the lower shear blades 36 and 37. Preferably, the shear blades 33, 34, 36 and 37 are replaceable.

Preferably, the apparatus 10 further has a guide blade 48 on the lower jaw 12 lying along the lower shear blade 36 and in spaced relation therewith, the outer end 50 of the guide blade and outer end 52 of the shear blade being adjacent each other, and rigid means 54 securing the outer ends 50, 52 together. The rigid means 54 is preferably a tie plate 56.

An open slot 58 preferably exists between the lower shear blade 36 and the adjacent guide blade 48 to receive the upper shear blade 34 therein, the open slot 58 having a width wider than the thickness of the upper shear blade 34 to maintain open space between the upper shear blade 34 and the guide blade 48 when the upper shear blade 34 is in the open slot 58.

On the first shearing side 22, the upper jaw will receive the upper primary shear blade 34 and the upper secondary shear blade 33. The shear blades 34 and 33 meet at the upper shear blade apex 35 which is the last point wherein the upper jaw 14 shears a work-piece against lower elongate shear blade 36. On the lower jaw 12, the lower primary shear blade 36 and lower secondary shear blade 37 are received.

Figure 2:
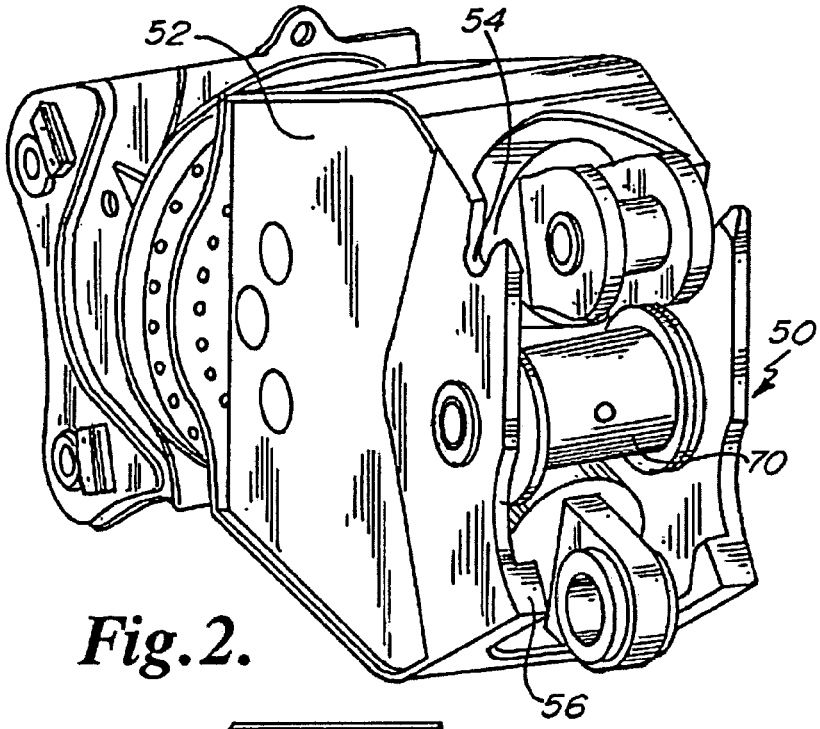
FIG. 2 is a perspective view of the portion of the apparatus (an adaptor) that receives the interchangeable jaw assembly.
Figure 3:
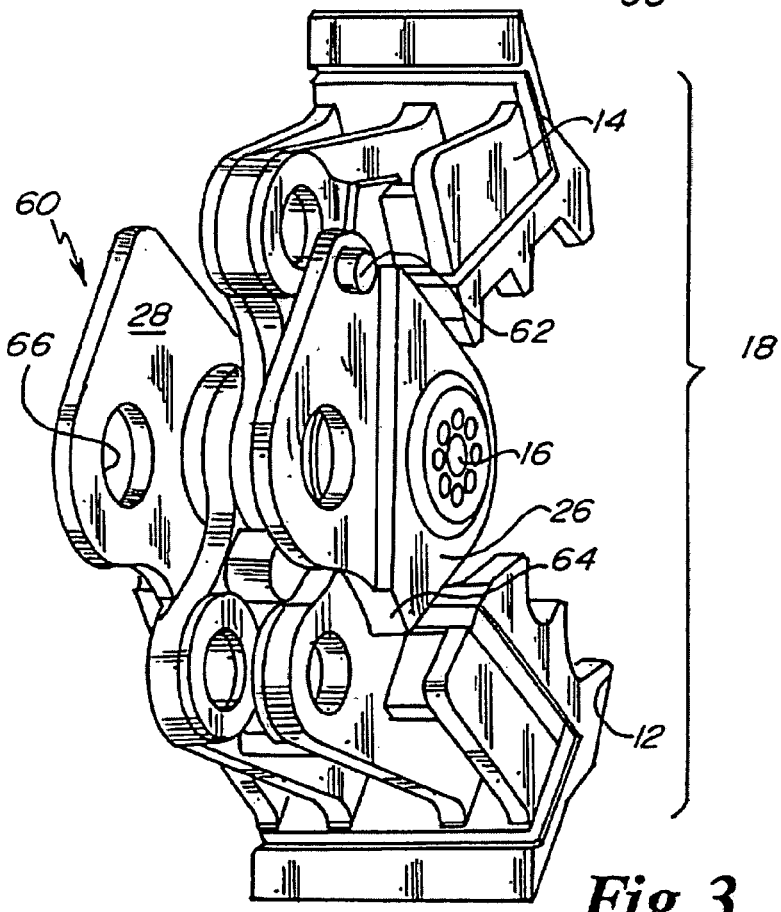
FIG. 3 is a rear perspective view of the interchangeable jaw assembly and an adaptor that mates with that of FIG. 2. This Figure also shows an embodiment of the jaws used for crushing instead of shearing.
Figure 4:
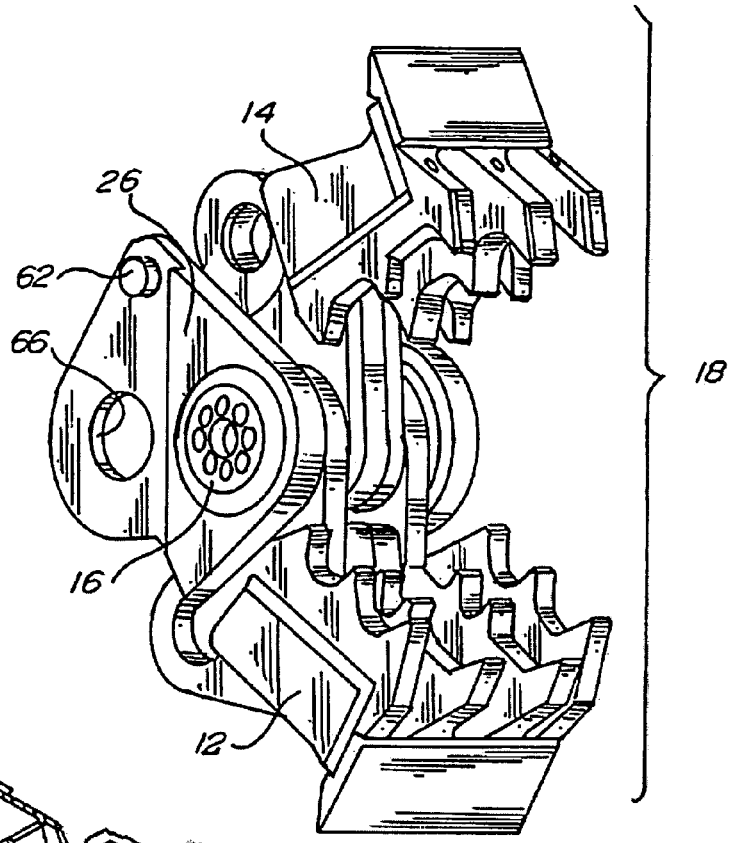
FIG. 4 is a front perspective view of the interchangeable jaw assembly of the present invention.

Turning to FIGS. 2 and 3, the apparatus 10 further comprises a first adaptor 50 on the boom structure 52 of an excavator; and a second adapter 60 on the jaw assembly 18. The second adaptor 60 engages the first adaptor 50, so that the jaw assembly 18 can be easily removed as a unit from the boom structure 52 and another jaw assembly installed thereon.

The apparatus 10 further comprises a lock pin 70 fixed to the first adapter 50 and engaging the second adapter 60 to maintain the jaw assembly 18 in locked relationship to the boom structure 52.

In the preferred embodiment, the first adaptor 50 further comprises a slot 54 and a first stop 56. The second adapter 60 further comprises a hook portion 62 engaging the slot 54 and a second stop 64 engaging the first stop 56. An aperture 66 receives the lock pin 70.

Figure 5:
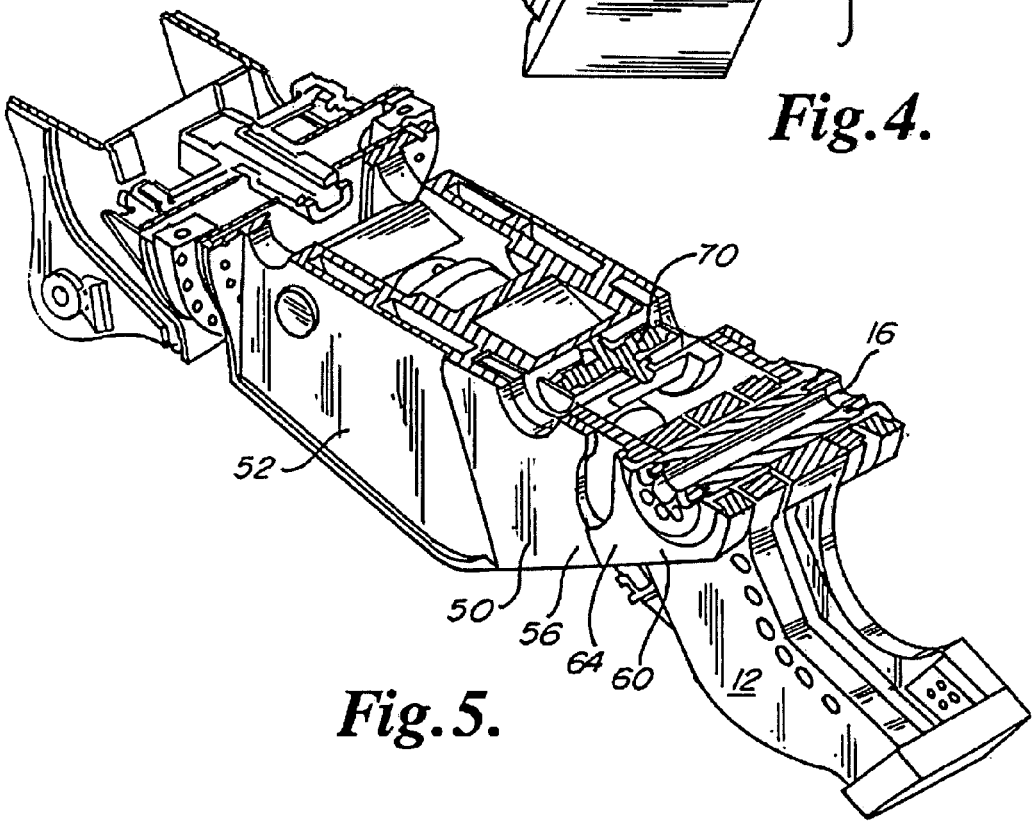
FIG. 5 is a perspective view of the interior of the present apparatus, showing the locking pins which hold the interchangeable jaws to the apparatus in a retracted position.
Figure 6:
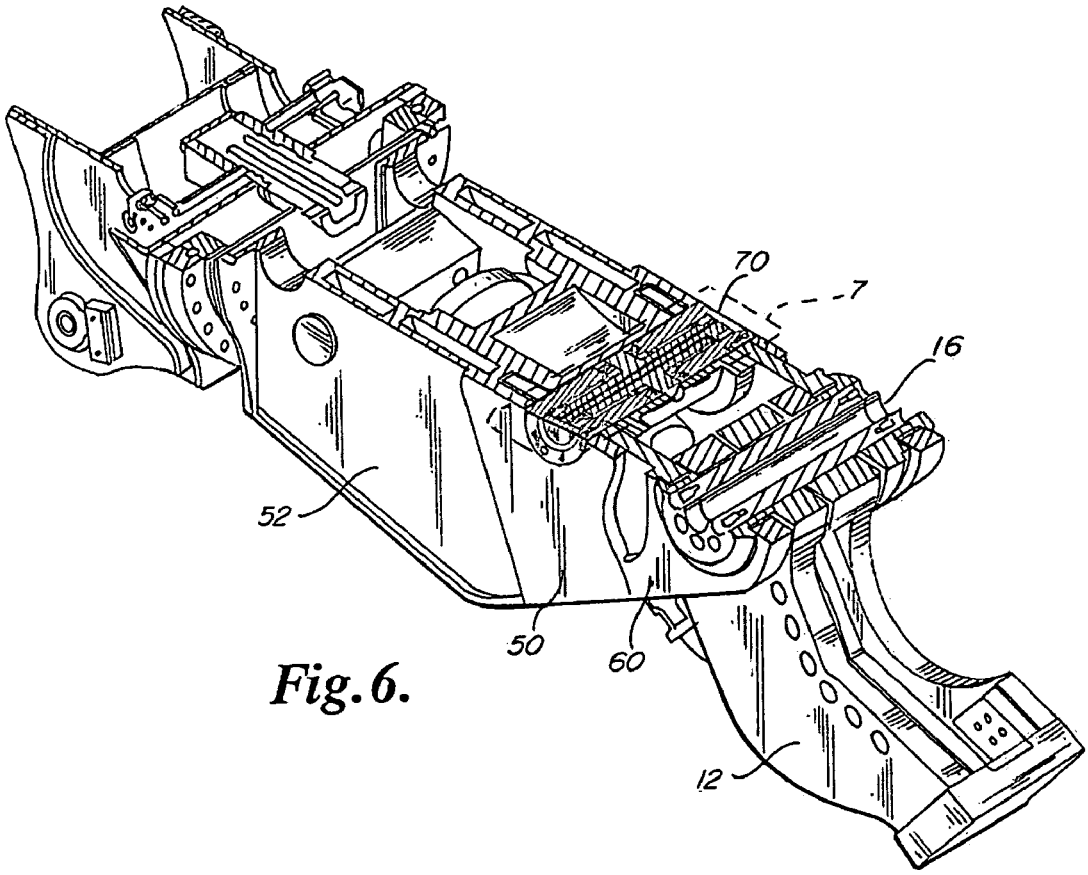
FIG. 6 is similar to FIG. 5, showing the locking pins in an extended and locked position.

Preferably, the lock pin 70 is movable between a retracted position (FIG. 5) wherein the lock pin does not engage the aperture 66 and an extended position (FIG. 6) wherein the lock pin engages the aperture 66, thereby locking the jaw assembly 18 to the boom structure 52.

Figure 7:
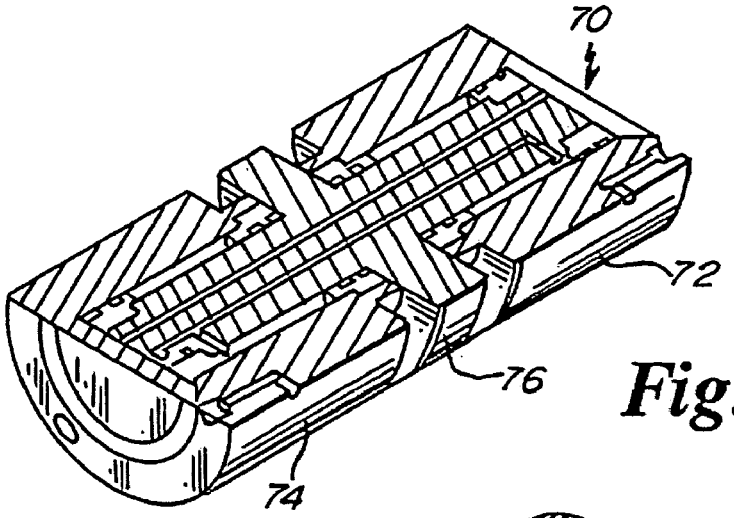
FIG. 7 is a detailed view of the dashed area in FIG. 6.
Figure 8:
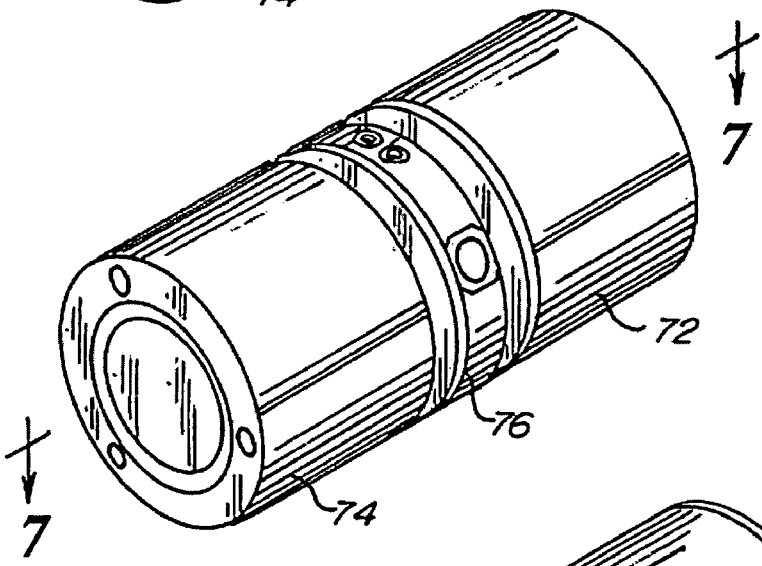
FIG. 8 is a detailed view of the hydraulic lock pins in the retracted position.
Figure 9:
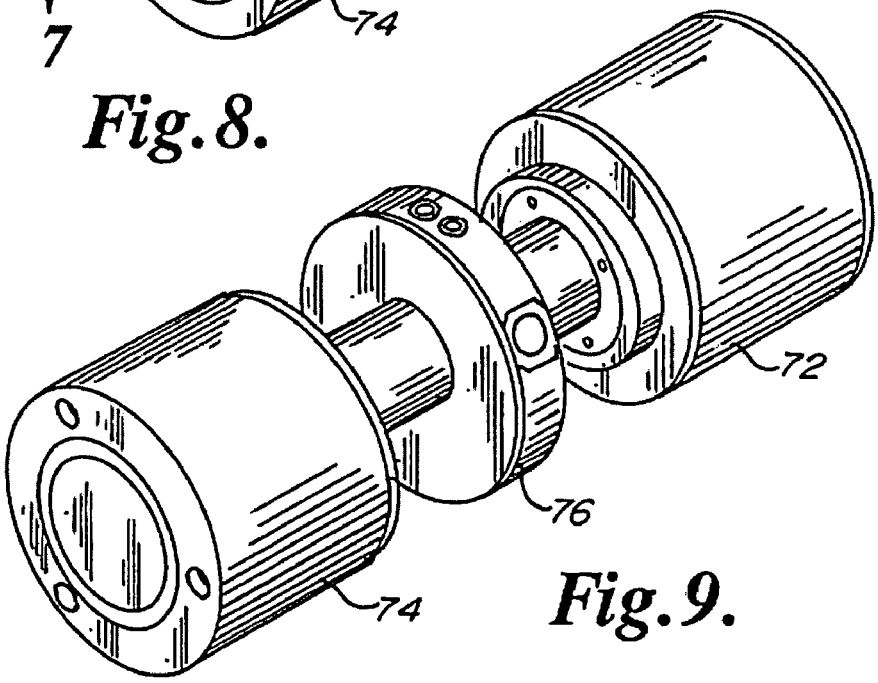
FIG. 9 is a detailed view of the hydraulic lock pins in the extended and locked position.
Figure 10:
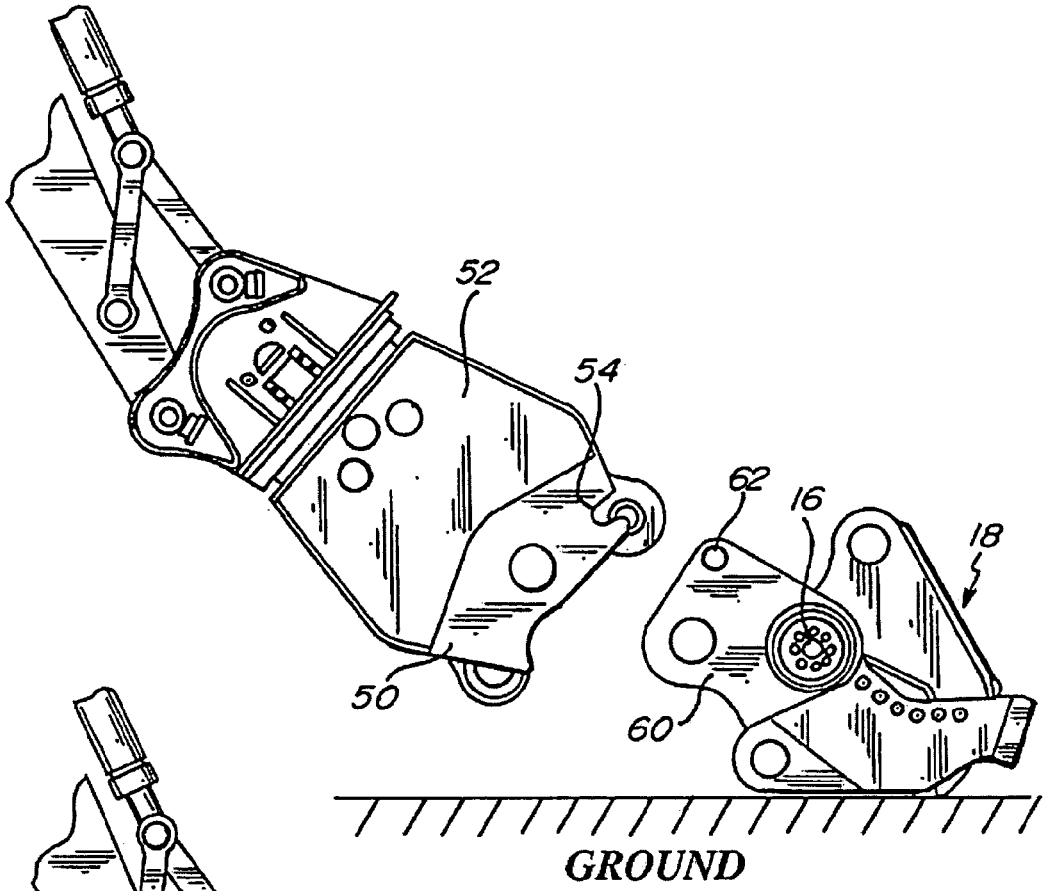
FIG. 10 is a side elevational view of the present invention showing a jaw assembly resting on the ground and being approached by the boom structure of the excavator.

Details of the preferred structure of the lock pin are shown in FIGS. 7-9. The lock pin 70 is preferably hydraulically activated. Most preferably, the lock pin 70 further comprises a pair of hydraulically activated lock pins 72, 74, extending and retracting radially. The lock pins 72, 74 are preferably connected to a common central manifold 76. The lock pins 72, 74 are shown in the retracted position in FIG. 8 and in the extended position in FIG. 9.

The present invention also has hydraulic rams 80 (FIGS. 13-15) on the boom structure which mate with corresponding apertures 82 on the second adapter, which then receive pins 84 as is known in the art.

Operation of the present invention may now be appreciated by studying FIGS. 10-13.

Figure 11:
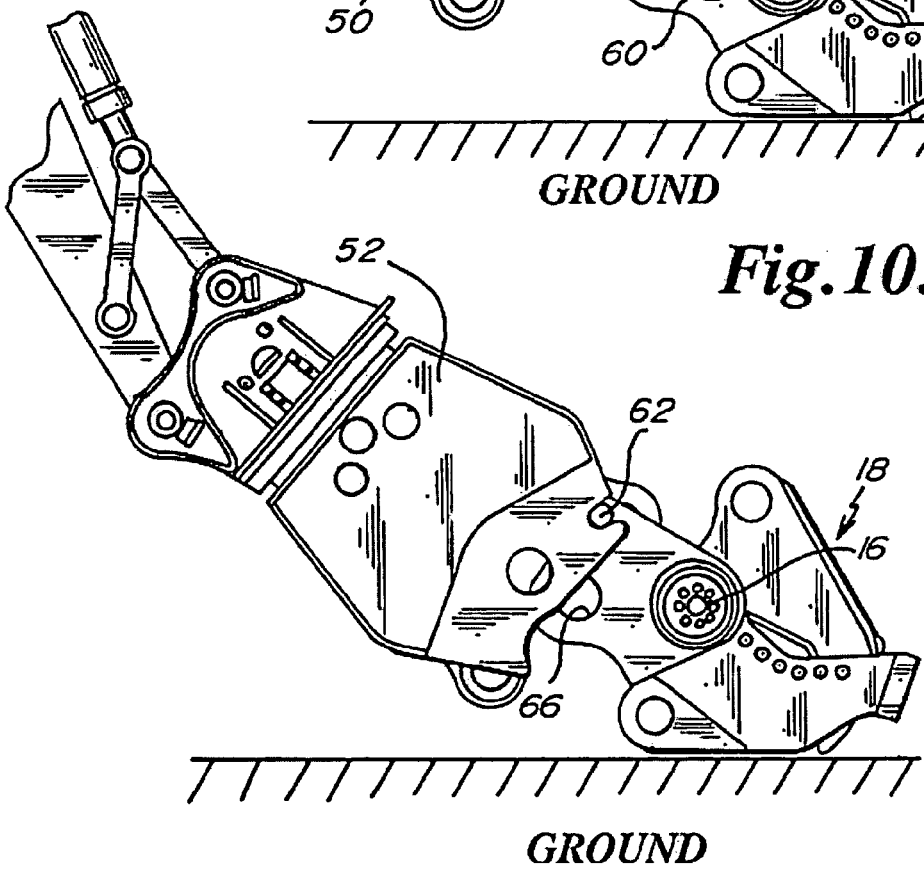
FIG. 11 is similar to FIG. 10, showing the hook on the first adaptor having been mated with a slot on the second adaptor.

As shown in FIG, 10, with a jaw assembly 18 sitting on the ground, the excavator's boom structure 52 with first adaptor 50 is moved to approach the second adaptor 60. FIG. 11 shows that the hook 62 is then inserted into the slot 54 on the second adaptor.

Figure 12:
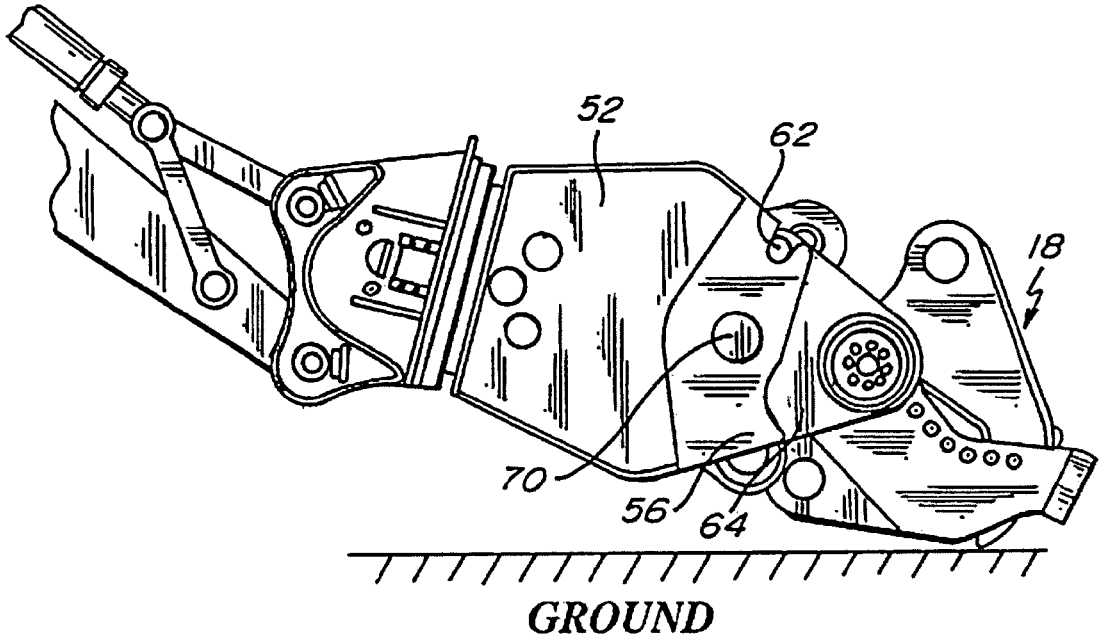
FIG. 12 is similar to FIG. 11, showing the first stop on the first adaptor contacting the second stop on the second adaptor, the jaw assembly having been lifted into place, and the lock pins extended to lock into the aperture on the second adaptor.

As shown in FIG. 12, the boom structure is then used to lift the jaw assembly 18, which pivots on the hook 62 so that the second stop 64 on the second adaptor makes physical contact with the first stop 56 on the first adaptor 50. Then the lock pins 70 are extended into the aperture 66 to lock the jaw assembly 18 to the boom structure 52.

Figure 13:
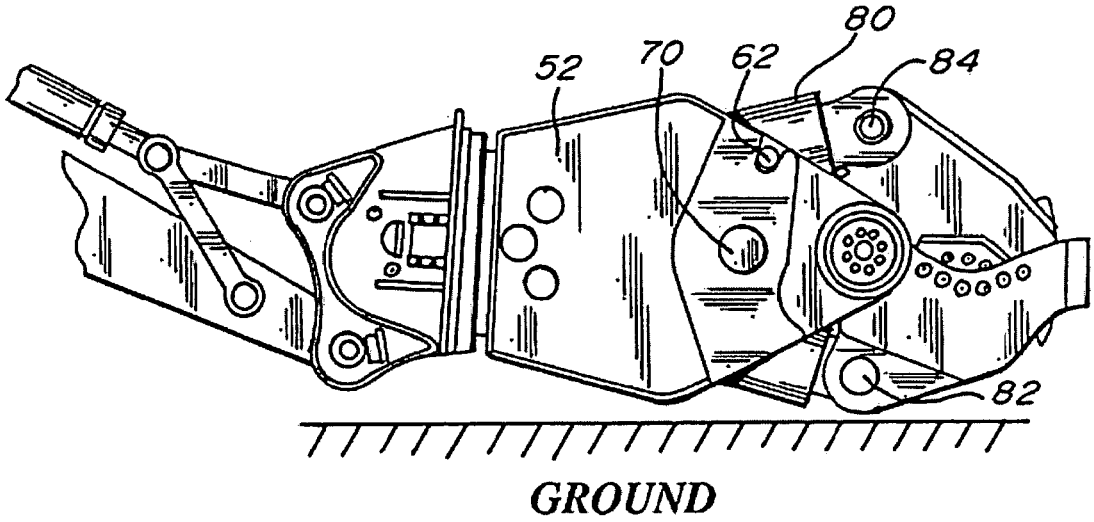
FIG. 13 is similar to FIG. 12, showing the hydraulic rams on the excavator boom structure extended and the rams attached to the jaw assembly by pins.
Figure 14:
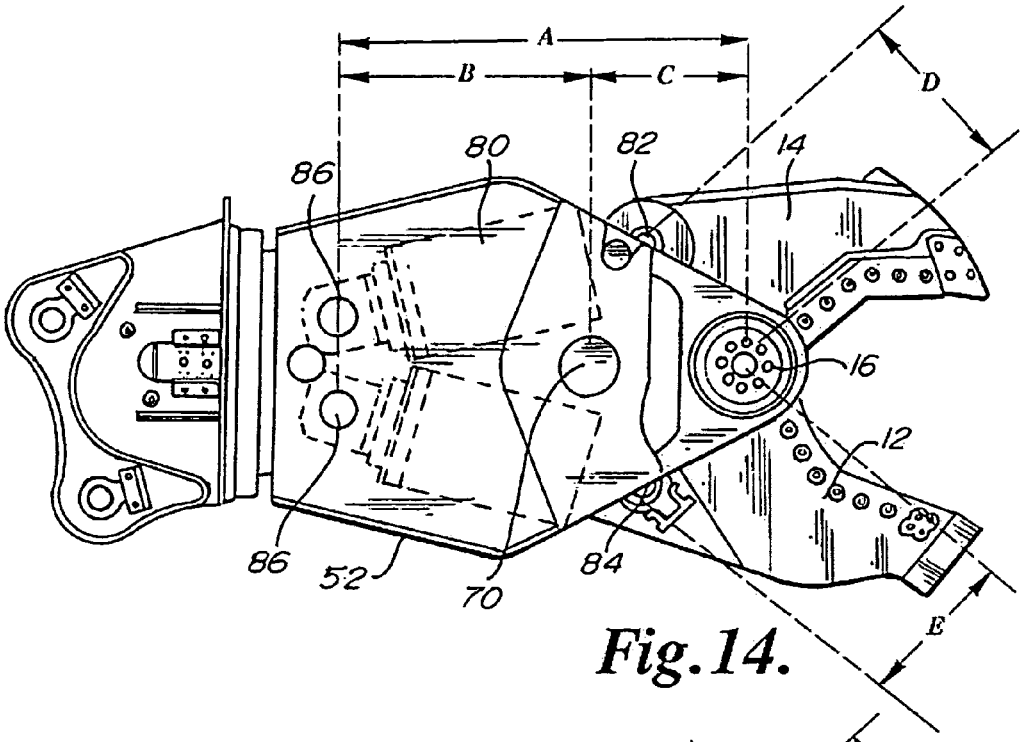
FIG. 14 is a side elevational view of the present invention, showing the internal structure of the hydraulic rams and the relationship between the lock pin and the main pivot pin for a first jaw assembly.
Figure 15:
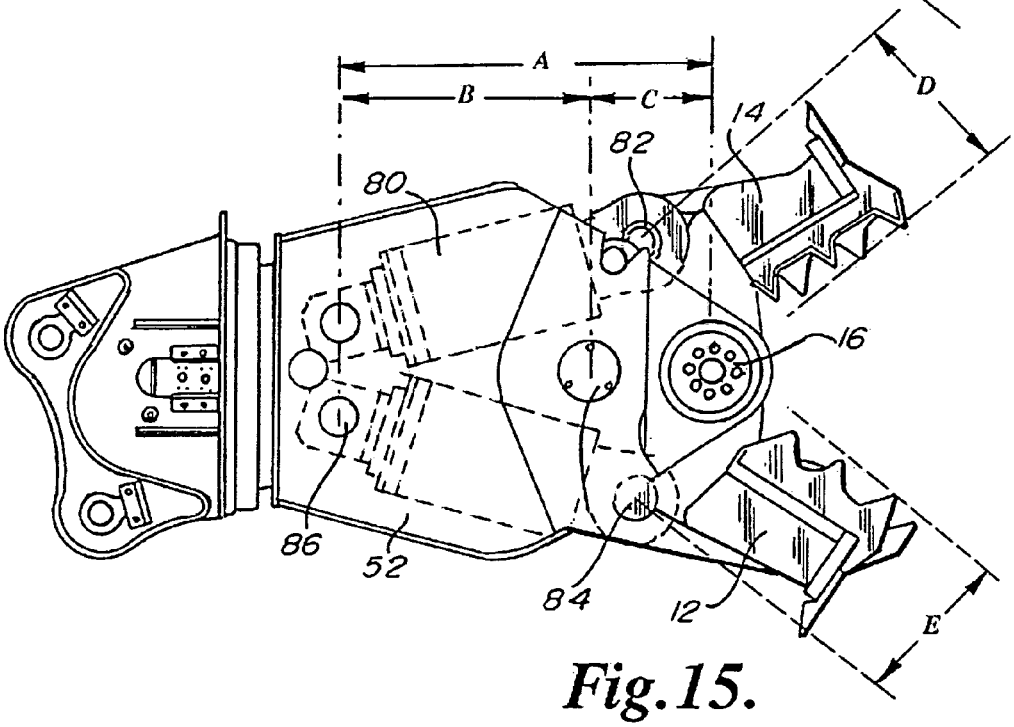
FIG. 15 is similar to FIG. 14, for a second jaw assembly.

As shown in FIGS. 13-15, the hydraulic rams 80 are then extended into the apertures 82 on the second adaptor 60 and the pins 84 are inserted into the apertures, thus connecting the hydraulic rams to the jaw assembly 18, so that the jaws 12 and 14 may then be opened and closed.

Turning to FIGS. 14 and 15, another advantage of the present invention may be appreciated.

In previous apparatuses with detachable jaws, such as disclosed in U.S. Pat. Re. 35,432, the distance A between the attachment point 86 of each hydraulic ram 80 on the boom structure, and the main pivot point 16 of the jaws, is fixed.

Applicant has found that it is advantageous to be able to vary the distance A for different jaw sets to produce different actions. As shown in FIGS. 14 and 15, the distance A can be varied between different interchangeable jaw assemblies by changing the distance C between the lock pin 70 and the main pivot point 16, while keeping the distance B between the attachment point 86 and the lock pin 70 fixed.

Furthermore, the present invention allows the distances D and E between the apertures 82 on the second adapter 60 and the main pivot pin 16 to be varied between interchangeable jaw assemblies, again to produce different actions for different jaw sets.

The present invention may be embodied in other specific forms without departing from the spirit or essential attributes thereof, and it is therefore desired that the present embodiment be considered in all respects as illustrative and not restrictive reference being made to the appended claims rather than to the foregoing description to indicate the scope of the invention.

What is claimed:

1. A heavy-duty demolition apparatus for attachment to the boom structure of an excavator, the apparatus having interchangeable jaw assemblies, the apparatus comprising:

(a) a unitary jaw assembly, comprising a pair of pivoting jaws connected by a main pivot pin;

(b) a first adaptor on the boom structure;

(c) a second adaptor on the jaw assembly, the second adaptor engaging the first adaptor, whereby the jaw assembly can be easily removed as a unit from the boom structure and another jaw assembly installed thereon; and (d) a lock pin fixed to the first adapter and engaging the second adapter to maintain the jaw assembly in locked relationship to the boom structure.

2. The apparatus of claim 1, wherein the first adaptor further comprises a slot and a first stop.

3. The apparatus of claim 2, wherein the second adaptor further comprises a hook portion engaging the slot, a second stop engaging the first stop, and an aperture receiving the lock pin.

4. The apparatus of claim 3, wherein the lock pin is movable between a retracted position wherein the lock pin does not engage the aperture and an extended position wherein the lock pin engages the aperture, thereby locking the jaw assembly to the boom structure.

5. The apparatus of claim 4, wherein the lock pin is hydraulically activated.

6. The apparatus of claim 5, further comprising a pair of hydraulically-activated lock pins, extending and retracting radially.

7. The apparatus of claim 6, wherein the pair of hydraulically-activated lock pins are connected to a common central manifold.

8. A heavy-duty demolition apparatus for attachment to the boom structure of an excavator, the apparatus having interchangeable jaw assemblies, the apparatus comprising:

(a) a unitary jaw assembly, comprising a pair of pivoting jaws connected by a main pivot pin;

(b) a first adaptor on the boom structure;

(c) a second adaptor on the jaw assembly, the second adapter further comprising an aperture, the second adaptor engaging the first adaptor, whereby the jaw assembly can be easily removed as a unit from the boom structure and another jaw assembly installed thereon; and (d) a lock pin fixed to the first adapter and engaging the second adapter to maintain the jaw assembly in locked relationship to the boom structure;

(e) wherein the lock pin is movable between a refracted position wherein the lock pin does not engage the aperture and an extended position wherein the lock pin engages the aperture, thereby locking the jaw set to the boom structure.

9. The apparatus of claim 8, wherein the first adaptor further comprises a slot and a first stop.

10. The apparatus of claim 9, wherein the second adaptor further comprises a hook portion engaging the slot, a second stop engaging the first stop, and an aperture receiving the lock pin.

11. The apparatus of claim 8, wherein the lock pin is hydraulically activated.

12. The apparatus of claim 11, further comprising a pair of hydraulically-activated lock pins, extending and retracting radially.

13. The apparatus of claim 12, wherein the pair of hydraulically-activated lock pins are connected to a common central manifold.

14. A heavy-duty demolition apparatus for attachment to the boom structure of an excavator, the apparatus having interchangeable jaw assemblies, the apparatus comprising:

(a) a unitary jaw assembly, comprising a pair of pivoting jaws connected by a main pivot pin;

(b) a first adaptor on the boom structure, wherein the first adaptor further comprises a slot and a first stop;

(c) a second adaptor on the jaw assembly, the second adaptor engaging the first adaptor, whereby the jaw assembly can be easily removed as a unit from the boom structure and another jaw assembly installed thereon; and (d) a lock pin fixed to the first adapter and engaging the second adapter to maintain the jaw assembly in locked relationship to the boom structure;

(e) wherein the second adaptor further comprises a hook portion engaging the slot, a second stop engaging the first stop, and an aperture receiving the lock pin.

15. The apparatus of claim 14, wherein the lock pin is movable between a retracted position wherein the lock pin does not engage the aperture and an extended position wherein the lock pin engages the aperture, thereby locking the jaw set to the boom structure.

16. The apparatus of claim 15, wherein the lock pin is hydraulically activated.

17. The apparatus of claim 16, further comprising a pair of hydraulically-activated lock pins, extending and retracting radially.

18. The apparatus of claim 17, wherein the pair of hydraulically-activated lock pins are connected to a common central manifold.

19. A heavy-duty demolition apparatus for attachment to the boom structure of an excavator, the apparatus having interchangeable jaw assemblies, the apparatus comprising:

(a) a unitary jaw assembly, comprising a pair of pivoting jaws connected by a main pivot pin;

(b) a first adaptor on the boom structure, wherein the first adaptor further comprises a slot and a first stop;

(c) a second adaptor on the jaw assembly, the second adaptor engaging the first adaptor, whereby the jaw assembly can be easily removed as a unit from the boom structure and another jaw assembly installed thereon; and (d) a lock pin fixed to the first adapter and engaging the second adapter to maintain the jaw assembly in locked relationship to the boom structure;

(e) wherein the second adaptor further comprises a hook portion engaging the slot, a second stop engaging the first stop, and an aperture receiving the lock pin;

(f) wherein the lock pin is movable between a refracted position wherein the lock pin does not engage the aperture and an extended position wherein the lock pin engages the aperture, thereby locking the jaw set to the boom structure.

20. The apparatus of claim 19, wherein the lock pin is hydraulically activated.

21. The apparatus of claim 20, further comprising a pair of hydraulically-activated lock pins, extending and retracting radially.

22. The apparatus of claim 21, wherein the pair of hydraulically-activated lock pins are connected to a common central manifold.

23. A heavy-duty demolition apparatus for attachment to the boom structure of an excavator, the boom structure having a hydraulic ram attached thereto at a first attachment point and the hydraulic ram having a second attachment point, the apparatus having interchangeable jaw assemblies, the apparatus comprising:

(a) a unitary jaw assembly, comprising a pair of pivoting jaws connected by a main pivot pin;

(b) a first adaptor on the boom structure;

(c) a second adaptor on the jaw assembly, the second adaptor engaging the first adaptor, whereby the jaw assembly can be easily removed as a unit from the boom structure and another jaw assembly installed thereon;

(d) a lock pin fixed to the first adapter and engaging the second adapter to maintain the jaw assembly in locked relationship to the boom structure;

(e) a hydraulic ram attached to the boom structure at a first attachment point and the hydraulic ram having a second attachment point; and (f) an aperture on the second adapter engaging the second attachment point of the hydraulic ram wherein the distance between the first attachment point of the hydraulic ram and the main pivot pin is variable between different interchangeable jaw assemblies.

24. The apparatus of claim 23, wherein the distance between the lock pin and the main pivot point is variable between different jaw assemblies.

25. The apparatus of claim 23, wherein the distance between the aperture on the second adapter and the main pivot pin is variable between different interchangeable jaw assemblies.

* * * * *

UNITED STATES PATENT AND TRADEMARK OFFICE

CERTIFICATE OF CORRECTION

PATENT NO. : 7,284,718 B2
APPLICATION NO. : 11/169562
DATED : October 23, 2007
INVENTOR(S) : Ross D. Christenson It is certified that error appears in the above-identified patent and that said Letters Patent is hereby corrected as shown below:

Column 6, line 4, please delete “refracted”, and in it’s place --retracted--.

Column 7, line 7 please delete “refracted”, and in it’s place --retracted--.

Signed and Sealed this

Fourth Day of March, 2008

JON W. DUDAS
*Director of the United States Patent and Trademark Office*